US011091871B2

(12) United States Patent
Leibman et al.

(10) Patent No.: US 11,091,871 B2
(45) **Date of Patent: *Aug. 17, 2021**

(54) PIVOTED FAUCET IN A LID OF A TOP LOAD WASHING MACHINE

(71) Applicant: Haier US Appliance Solutions, Inc., Wilmington, DE (US)

(72) Inventors: Alexander B. Leibman, Prospect, KY (US); Wayne E. Lawson, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 91 days.

This patent is subject to a terminal disclaimer.

(21) Appl. No.: 16/279,116

(22) Filed: Feb. 19, 2019

(65) Prior Publication Data

US 2020/0263344 A1 Aug. 20, 2020

(51) Int. Cl.
*D06F 39/08* (2006.01)
*E03C 1/02* (2006.01)
(Continued)

(52) U.S. Cl.
CPC ..... *D06F 39/088* (2013.01); *D06F 37/28* (2013.01); *D06F 39/14* (2013.01); *E03C 1/025* (2013.01)

(58) Field of Classification Search
CPC ..... D06F 39/08; D06F 39/083; D06F 39/088; D06F 39/14; D06F 37/28; D06F 29/00;
(Continued)

(56) References Cited

U.S. PATENT DOCUMENTS 1,505,492 A 8/1924 Reddig
2,790,632 A * 4/1957 Mellette ..... A47L 17/00 239/26

(Continued)

FOREIGN PATENT DOCUMENTS

CN 103276557 A 9/2013
DE 19546965 A1 6/1997
JP 3114147 U 9/2005

OTHER PUBLICATIONS

Cambridge Dictionary, Operable| Definition in the Cambridge English Dictionary, 2020. https://dictionary.cambridge.org/us/dictionary/english/operable (Year: 2020).*

*Primary Examiner* — Michael E Barr
*Assistant Examiner* — Omair Chaudhri
(74) *Attorney, Agent, or Firm* — Dority & Manning, P.A.

(57) ABSTRACT

A top-loading washing machine appliance with a pivoted faucet mounted on the underside of the lid of the washing machine appliance is provided herein. The washing machine appliance may include a cabinet, a tub positioned within the cabinet, a wash basket, a lid, a position sensor, and a faucet mounted to the lid. The position sensor may be operable to sense whether the lid is in the closed position or the open position. The faucet may be mounted to the lid with a pivotable joint such that the faucet may pivot between a retracted position and an extended position. The retracted position of the faucet may be such that the faucet does not extend within the wash basket when the lid is in the closed position. The extended position of the faucet may be such that the outlet of the faucet is over the wash basket when the lid is in the open position.

17 Claims, 7 Drawing Sheets

(51) Int. Cl.
*D06F 39/14* (2006.01)
*D06F 37/28* (2006.01)

(58) Field of Classification Search
CPC .. D06F 7/00–06; D06F 1/00–12; D06F 37/42; D06F 39/006; D06F 33/04–10; D06F 33/47; A47L 15/0089; B08B 3/006
See application file for complete search history.

(56) References Cited

U.S. PATENT DOCUMENTS

| | | | | |
|---|---|---|---|---|
| 2,952,271 | A | 9/1960 | Gray | |
| 3,031,871 | A | 5/1962 | Bailey | |
| 3,039,284 | A | 6/1962 | Shelton et al. | |
| 3,064,678 | A | 11/1962 | Shames | |
| 3,306,319 | A | 2/1967 | Kendt et al. | |
| 3,444,890 | A | 5/1969 | Ralston | |
| 3,593,743 | A | 7/1971 | Guth | |
| 3,630,227 | A | 12/1971 | Race | |
| 3,635,243 | A | 1/1972 | Brezosky | |
| 3,717,173 | A | 2/1973 | Nyberg | |
| 4,580,600 | A | 4/1986 | Mazzei | |
| 4,877,049 | A | 10/1989 | Fornasari | |
| 5,156,634 | A | 10/1992 | Yang | |
| 5,758,690 | A | 6/1998 | Humpert et al. | |
| 6,557,382 | B1 | 5/2003 | Koike et al. | |
| 6,886,371 | B2 | 5/2005 | Arai et al. | |
| 7,735,345 | B2 | 6/2010 | Wright et al. | |
| 8,549,887 | B2 | 10/2013 | Reid et al. | |
| 2002/0129861 | A1 | 9/2002 | Holdenried | |
| 2002/0134117 | A1 | 9/2002 | Arai et al. | |
| 2005/0127194 | A1 | 6/2005 | Lahrmann et al. | |
| 2009/0078007 | A1 | 3/2009 | Bae et al. | |
| 2009/0255299 | A1 | 10/2009 | Hiro et al. | |
| 2017/0306552 | A1* | 10/2017 | Leibman | D06F 39/088 |
| 2019/0024294 | A1* | 1/2019 | Araujo | D06F 37/28 |
| 2019/0276976 | A1* | 9/2019 | Leibman | D06F 39/088 |
| 2020/0181828 | A1* | 6/2020 | Carpenter | D06F 29/00 |
| 2020/0224357 | A1* | 7/2020 | Leibman | D06F 39/088 |

* cited by examiner

PIVOTED FAUCET IN A LID OF A TOP LOAD WASHING MACHINE

FIELD OF THE INVENTION

The present subject matter generally relates to a top-loading washing machine appliance and, more particularly, to a user activated faucet assembly mounted to the lid of a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

However, use of such a washing machine appliance alone is often insufficient to fully clean articles that are particularly soiled or stained. Indeed, normal use of a washing machine to treat stained articles may cause a stain to set, resulting in a permanent blemish on the article. Users are therefore sometimes required to pre-treat such articles by applying stain removers or other similar wash fluids to the affected areas of the articles and washing such articles by hand prior to use of a washing machine appliance for normal cleaning activities.

Pre-treatment of articles may involve the application of water and possibly other liquids. Although some laundry rooms are equipped with a sink and drain, the laundry room in some homes may lack such features and the space to add them. Even when space is available, the cost of adding a sink, and the accompanying plumbing required to operate it may be prohibitive or not feasible. Thus users may be required to pre-treat soiled articles without a sink or in another room where a sink is available. A user may prepare cleaning rags or brushes from a sink and bring them to the laundry room. When numerous articles require pre-treatment, a person may be required to travel back and forth between the laundry room and the remote sink multiple times.

Accordingly, a top-loading washing machine appliance that provides a water supply that a user may conveniently use in the washing process would be beneficial.

BRIEF DESCRIPTION OF THE INVENTION

Aspects and advantages of the invention will be set forth in part in the following description, or may be obvious from the description, or may be learned through practice of the invention.

In exemplary aspects of the present disclosure, a washing machine appliance is provided. The washing machine appliance may include a cabinet, a tub positioned within the cabinet, a wash basket, a lid, and a faucet mounted to the lid. The wash basket may be rotatably mounted within the tub. The wash basket may define a wash chamber for receiving articles for washing. The lid may be mounted to a top panel of the cabinet. The lid may be adjustable between a closed position and an open position. In the closed position, the lid may be positioned over the wash tub. The faucet may have an inlet and an outlet. The faucet may also be mounted to the lid with a pivotable joint such that the faucet may pivot relative to the lid about at least one of the vertical direction, the lateral direction, or the transverse direction. The faucet may also pivot between a retracted position and an extended position. The retracted position of the faucet may be such that the faucet does not extend within the wash basket when the lid is in the closed position. The extended position of the faucet may be such that the outlet of the faucet is over the wash basket when the lid is in the open position. The inlet of the faucet may be connected to a wash fluid source and configured for selectively providing a flow of wash fluid into the wash basket when the lid is open.

In other exemplary aspects of the present disclosure, a washing machine appliance is provided. The washing machine appliance may include a cabinet, a tub positioned within the cabinet, a wash basket, a lid, a position sensor, and a faucet mounted to the lid. The wash basket may be rotatably mounted within the tub. The wash basket may define a wash chamber for receiving articles for washing. The lid may be mounted to a top panel of the cabinet. The lid may be adjustable between a closed position and an open position. In the closed position, the lid may be positioned over the wash tub. The position sensor may be operable to sense whether the lid is in the closed position or the open position. The faucet may have an inlet and an outlet. The faucet may also be mounted to the lid with a pivotable joint such that the faucet may pivot relative to the lid about at least one of the vertical direction, the lateral direction, or the transverse direction. The faucet may also pivot between a retracted position and an extended position. The retracted position of the faucet may be such that the faucet does not extend within the wash basket when the lid is in the closed position. The extended position of the faucet may be such that the outlet of the faucet is over the wash basket when the lid is in the open position. The inlet of the faucet may be connected to a wash fluid source and configured for selectively providing a flow of wash fluid into the wash basket when the lid is open.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
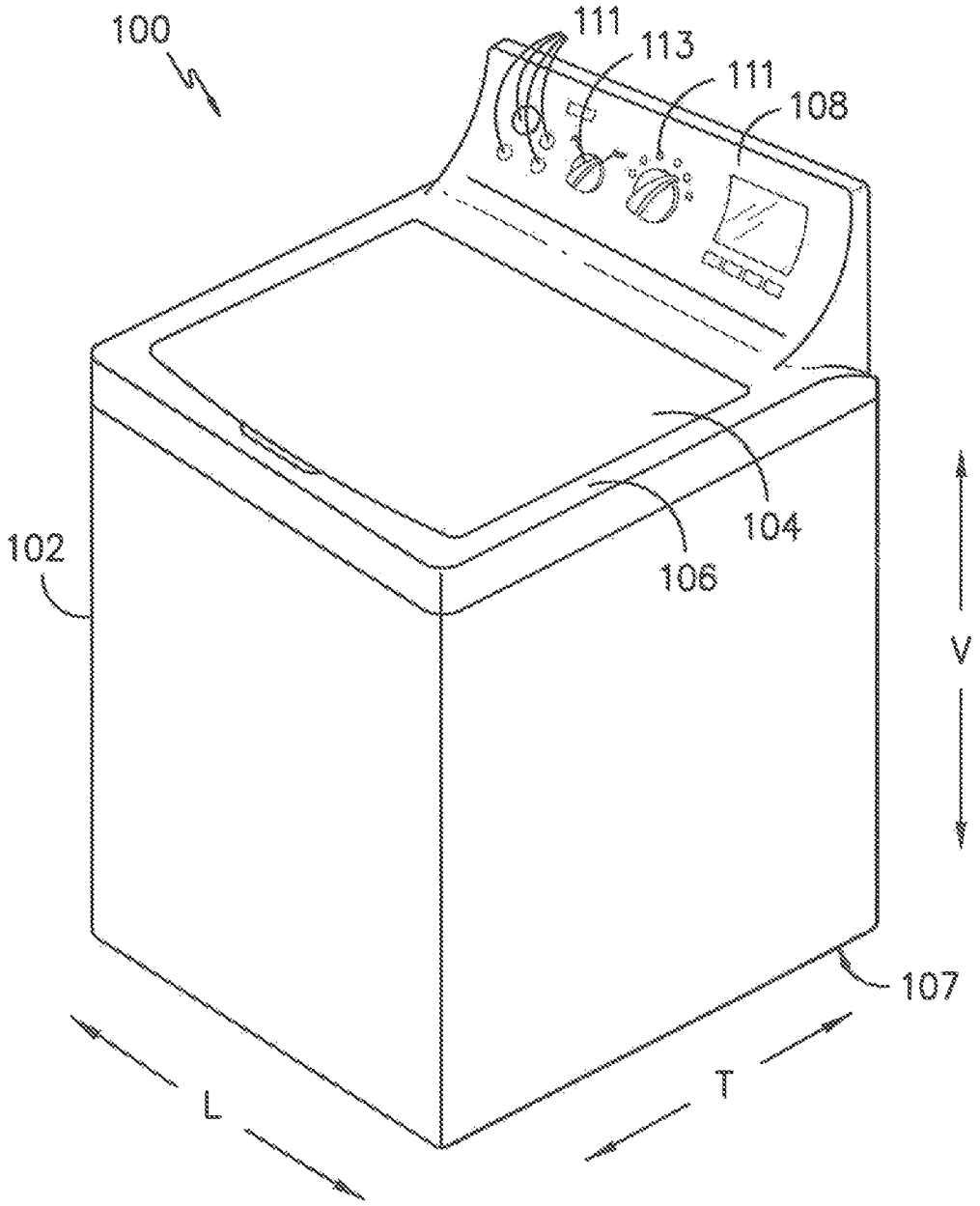
FIG. 1 provides a perspective view of a washing machine appliance according to an exemplary embodiment of the present disclosure with a lid of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents In order to aid understanding of this disclosure, several terms are defined below. The defined terms are understood to have meanings commonly recognized by persons of ordinary skill in the art relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
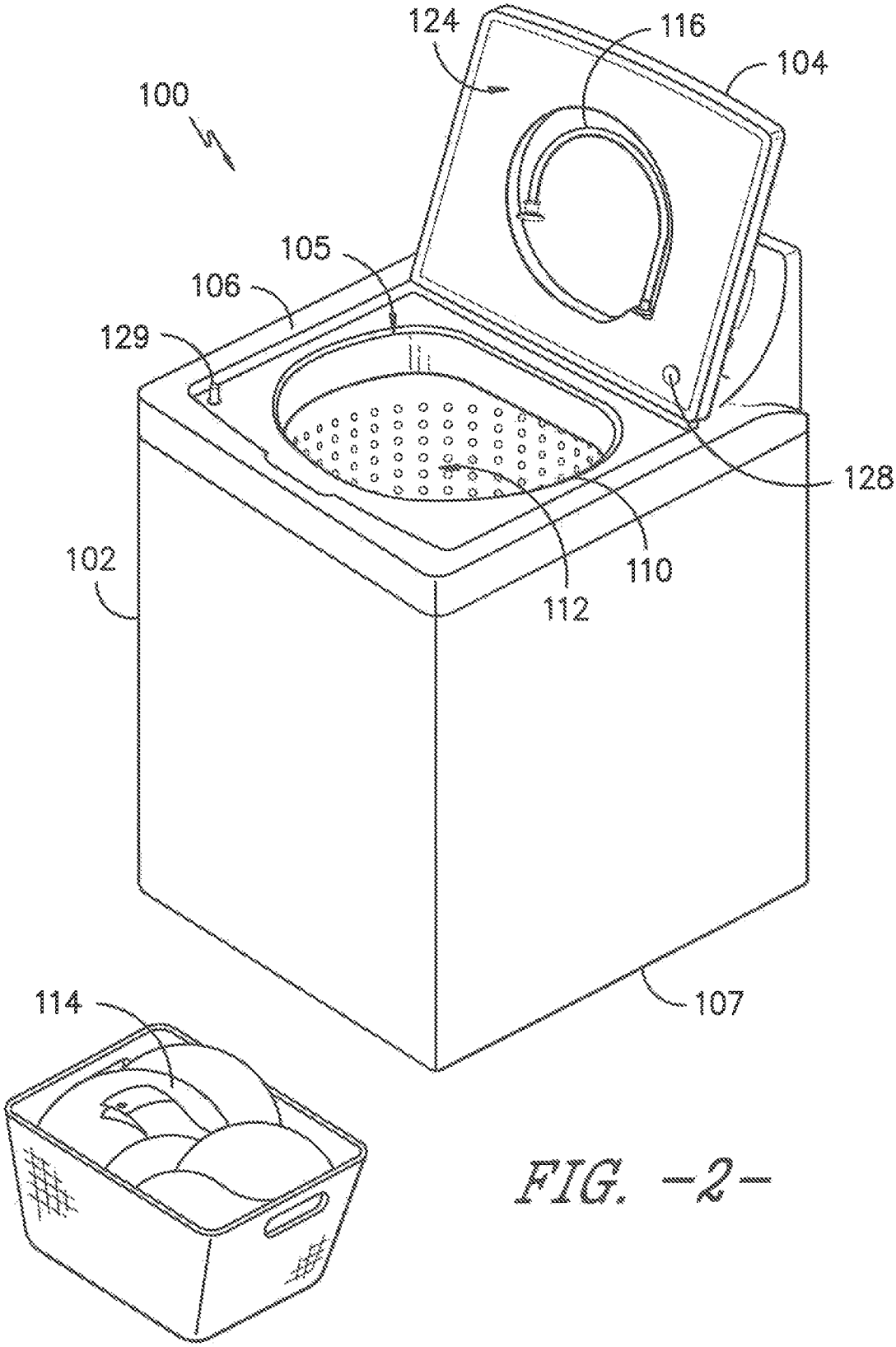
FIG. 2 provides a perspective view of the exemplary washing machine appliance of FIG. 1 with the lid of the exemplary washing machine appliance shown in an open position.

Turning now to the figures, FIGS. 1 and 2 illustrate an exemplary embodiment of a washing machine appliance 100. In particular, appliance 100 is shown as a vertical axis, or top-loading washing machine. In FIG. 1, a lid 104 is shown in a closed position. In FIG. 2, lid 104 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of washing machine appliance 100, using the teachings disclosed herein it will be understood that washing machine appliance 100 is provided by way of example only. Other washing machine appliances having different configurations, different appearances, or different features may also be utilized with the present subject matter as well.

Washing machine appliance 100 has a cabinet 102 that extends between a top panel 106 and a bottom 107 along the vertical direction V. A wash basket 110 is then rotatably mounted within a tub (not shown in the drawings). Wash basket 110 defines an interior volume that constitutes a wash chamber 112. A motor (not shown) is in mechanical communication with wash basket 110 to selectively rotate wash basket 110 (e.g., during an agitation cycle or a rinse cycle of washing machine appliance 100). Wash basket 110 is received within a wash tub mounted within cabinet 102 and is configured for receipt of articles 114 for washing. The wash tub holds wash and rinse fluids for agitation in wash basket 110 within the wash tub. An agitator or impeller (not shown) may extend into wash basket 110 while remaining in mechanical communication with the motor. The impeller generally assists agitation of articles disposed within wash basket 110 and may rotate or oscillate during operation of washing machine appliance 100.

Cabinet 102 of washing machine appliance 100 generally includes a top panel 106. Top panel 106 defines an opening 105 that permits user access to wash basket. In some embodiments, lid 104 is rotatably mounted to top panel 106 and permits selective access to opening 105. In particular, lid 104 selectively rotates between the closed position shown in FIG. 1 and the open position shown in FIG. 2. In the closed position, lid 104 inhibits access to wash basket 110. Conversely, in the open position, a user can access wash basket 110. In some embodiments, a window in lid 104 permits viewing of wash basket 110 when lid 104 is in the closed position (e.g., during operation of washing machine appliance 100). Lid 104 may also include a handle that, for example, a user may pull or lift when opening and closing lid 104.

In certain embodiments, a control panel 108 (FIG. 1) with one or more user inputs 111 extends from top panel 106. Control panel 108 and user inputs 111 collectively form a user interface input for operator selection of machine cycles and features.

Operation of washing machine appliance 100 is generally controlled by a controller or processing device (not pictured) that, in one embodiment, is attached to cabinet 102 (e.g., within control panel 108). Alternatively, the controller may be contained within the cabinet itself. The controller is operatively coupled (e.g., electrically coupled via one or more conductive signal lines, wirelessly coupled via one or more wireless communications bands, etc.) to portions of control panel 108 for user manipulation to select washing machine cycles and features. In response to user manipulation of control panel 108, including user inputs 111, the controller receives one or more signals (e.g., user-input signals) and operates the various components of washing machine appliance 100 to execute selected machine cycles and features.

The controller may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 108 and other components of washing machine appliance 100 may be in communication with the controller via one or more signal lines or shared communication busses.

Referring back to FIG. 2, during operation of washing machine appliance 100, laundry items are generally loaded into wash basket 110 through top opening 105, and a washing operation or wash cycle is initiated through operator manipulation of user inputs 111. Wash basket 110 is filled with a fluid, such as water, detergent, other fluid additives (e.g., via a nozzle assembly or a separate suitable fill spout). Moreover, one or more valves can be controlled by washing machine appliance 100 to provide for filling wash basket 110 to the appropriate level for the amount of articles being washed or rinsed. By way of example, for a wash cycle, once wash basket 110 is properly filled with fluid, the contents of wash basket 110 can be agitated (e.g., with an impeller as discussed above) for washing laundry items in wash basket 110.

After agitation (e.g., an agitation phase of the wash cycle) is completed, wash basket 110 can be drained. Laundry articles can then be rinsed by again adding fluid to wash basket 110 depending on the specifics of the wash cycle selected by a user. The impeller may again provide agitation within wash basket 110. One or more spin cycles also may be used. In particular, a spin cycle may be applied after the wash cycle or after the rinse cycle to wring wash fluid from the articles being washed. During a spin cycle, wash basket 110 is rotated at relatively high speeds. After laundry items or articles disposed in wash basket 110 are cleaned or washed, the user can remove the articles from wash basket 110 (e.g., by reaching into wash basket 110 through top opening 105).

Although such a wash cycle may be adequate in certain situations, articles that are particularly soiled or stained may require pre-treatment prior to normal use of the washing appliance. Pre-treatment of articles of wash will typically require the application of water and other wash fluids, presenting a problem, as some laundry rooms lack a convenient source of water. Accordingly, washing machine appliance 100 provides a faucet 116 mounted to lid 104, embodiments of which are shown in FIGS. 2-7. Faucet 116 is configured to dispense water under various conditions, as further described below, providing for convenient access to water in the pretreatment process. Specifically, faucet 116 is mounted to an interior surface 124 of lid 104, the surface 124 being concealed from view when lid 104 is in the closed position and exposed to the operator when lid 104 is in the open position. Faucet 116 may be mounted in any position on lid surface 124 that will accommodate the size of the faucet and is consistent with the teachings herein. This positioning of faucet 116 thus utilizes the existing tub and drain of washing machine appliance 100 to dispose of water dispensed by faucet 116.

Although the discussion below refers to faucet 116, one skilled in the art will appreciate that the features and configurations described may be used for other fluid supply assemblies in other washing machine appliances as well. For example, faucet 116 may be positioned in another location on lid surface 124, may have a different fluid supply conduit configuration, or may be oriented in a different direction. Other variations and modifications of the exemplary embodiments described below are possible, and such variations are contemplated as within the scope of the present disclosure.

Faucet 116 may be may be made of any rigid or semi-rigid material (e.g. aluminum, stainless steel, plastic) that enables the faucet to substantially maintain its shape and dimensions. As illustrated, faucet 116 may be configured in a U-shape. However, the shape of faucet 116 may take any shape that is consistent with the teachings herein. Faucet 116 includes a faucet inlet 118 and a faucet outlet 120. Water enters the faucet 116 through faucet inlet 118 and exits the faucet 116 through faucet outlet 120.

Faucet inlet 118 is attached to and supported by lid 104 by a pivotable joint 122 such that faucet 116 may pivot relative to lid 104. For example, in at least some embodiments, faucet 116 is rotatable relative to lid 104 about one or more of the vertical direction V, the lateral direction L, and the transverse direction T. In one embodiment, the pivotable joint may be a hinge joint, allowing the faucet to pivot relative to the lid about a single axis. In another embodiment, the pivotable joint may be a ball joint such that the faucet is rotatable relative to the lid with at least three degrees of freedom. These examples are not intended to be limiting and one of ordinary skill in the art would recognize that any pivotable joint known in the art that permits movement of the faucet relative to the lid falls within the scope of the invention.

Faucet outlet 120 permits the flow of water to exit faucet 116. Accordingly, faucet outlet 120 can take any physical form consistent with this purpose. For example, faucet outlet 120 may consist of a simple hole at the end of faucet 116 or a spout, out of which water in faucet 116 pours. In alternative embodiments, the faucet outlet may include features that aid in the task of pre-treating articles of wash, such as a spray nozzle for distributing the flow of water, or jet nozzle for a higher pressure output.

Figure 7:
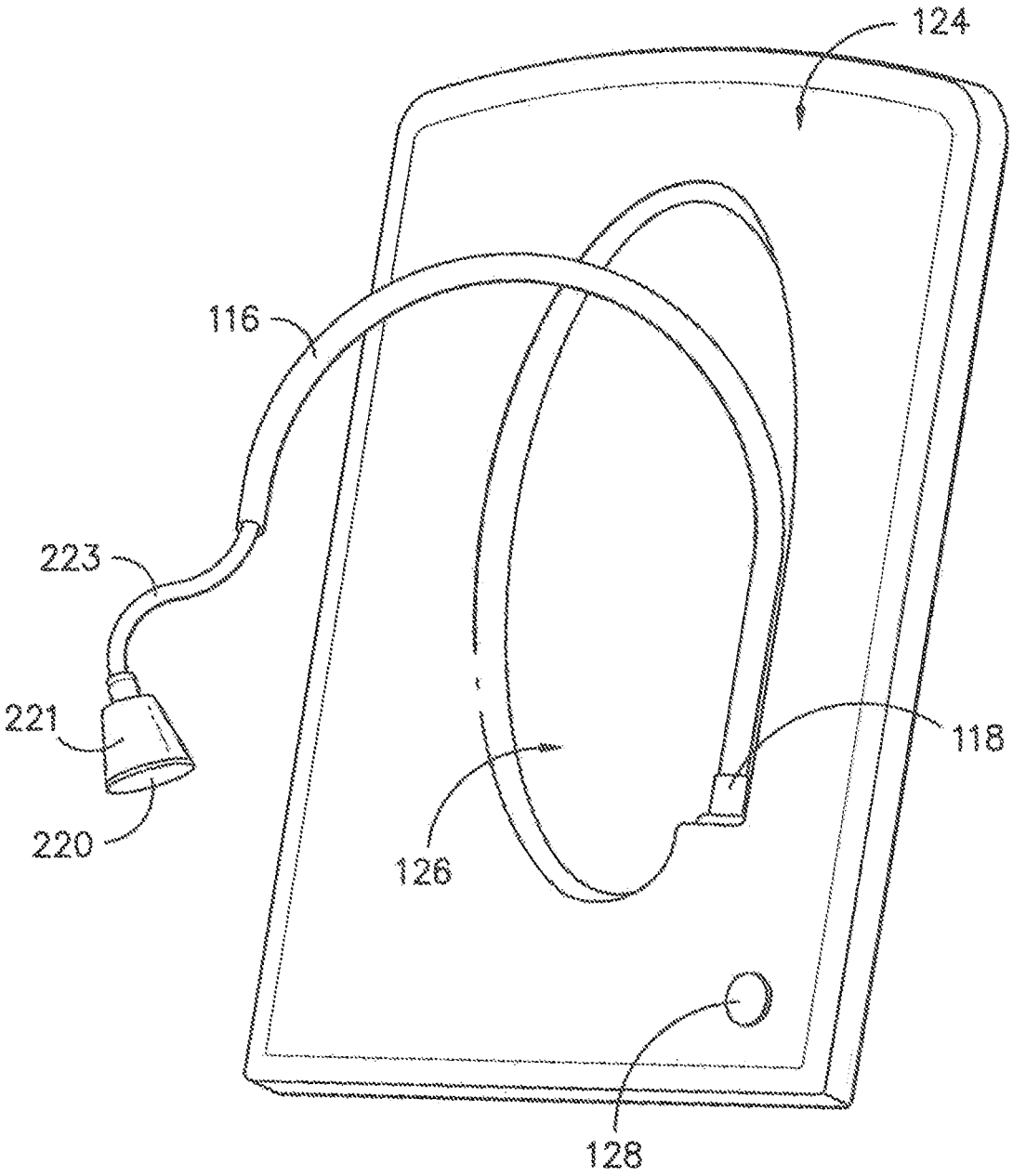
FIG. 7 provides a perspective view of an exemplary embodiment of the lid of a washing machine appliance with an exemplary faucet in the extended position and with a faucet outlet that is extendable from the faucet.

In yet another embodiment, the faucet outlet 120 itself may be moveable to enable a user to direct the flow of water as desired. For example, as depicted in FIG. 7, a faucet outlet 220 may include an extendable head 221 connected to a flexible conduit 223 that allows a user to position faucet outlet 220 over soiled portions of the articles of wash, rather than moving the articles under the fixed end of the faucet outlet. In this embodiment, faucet outlet 220 would be attached to a water supply by a fluid supply conduit 223 that extends through the faucet 116. In a retracted position, the fluid supply conduit 223 would be at least partially contained with the faucet 116. In an extended position, a certain length of the fluid supply conduit 223 would emerge from the faucet 116 to allow faucet outlet 220 to be moved within a radius of the extended supply line length. Methods for attaching the fluid supply conduit of an extendable faucet head are known in the art. Additionally, as also known to those of skill in the art, the fluid supply conduit 223 may be connected at one end via a spring (not pictured) such that extension of the fluid supply conduit 223 from faucet 116 applies tension to the spring, causing the fluid supply conduit 223 to automatically retract once it is released.

In a further alternative embodiment, the faucet outlet may be attached to the faucet by a pivotable joint (not pictured) which enables movement of the faucet outlet relative to the faucet. For example, the pivotable joint may be a hinge joint that enables rotation of the faucet outlet relative to the faucet about a single axis. As another example, the pivotable joint may be a ball joint that enables rotation with at least three degrees of freedom relative to the faucet. The use of a pivotable joint to connect the faucet outlet and the faucet enables a user to direct the flow of water as desired. Of course, any suitable combination of features of the faucet outlet discussed above may be used together, such as, for example, an extendable head with a spout outlet or pivotable head with a spray nozzle, as would be understood by one of ordinary skill in the art.

Figure 4:
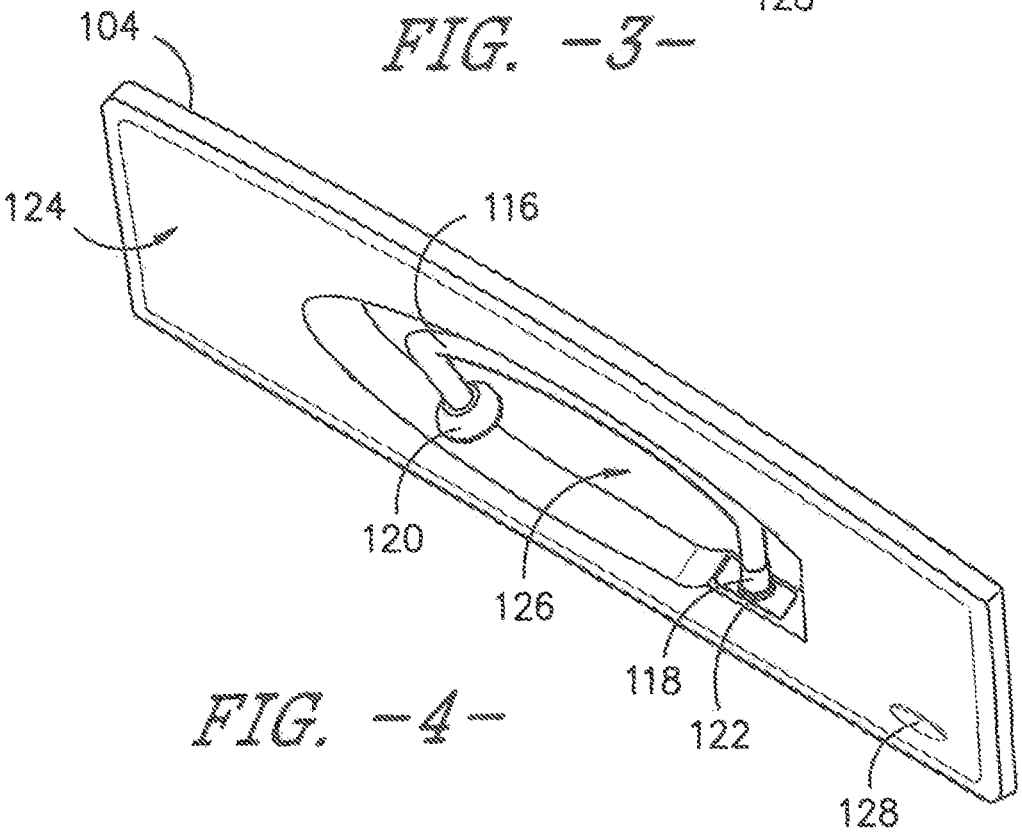
FIG. 4 provides another view of an exemplary embodiment of the lid of a washing machine appliance with an exemplary faucet in the retracted position from FIG., but from a different perspective.
Figure 5:
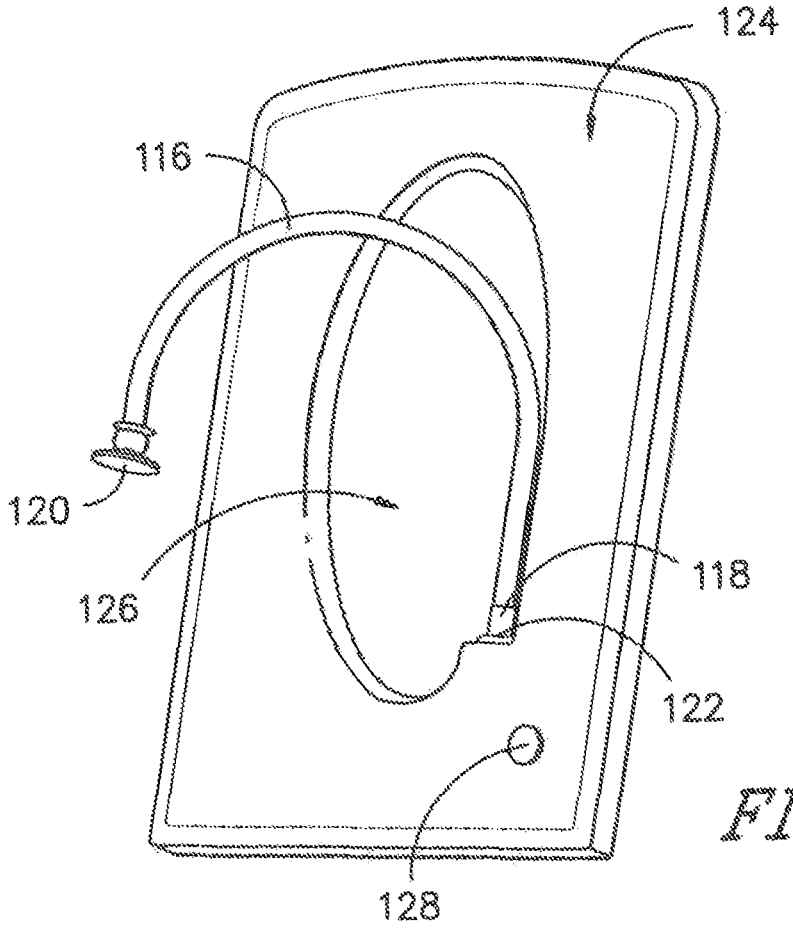
FIG. 5 provides a perspective view of an exemplary embodiment of the lid of a washing machine appliance with an exemplary faucet in the extended position.

As previously explained, pivotable joint 122 allows for rotation of faucet 116 relative to lid 104 about at least one of the vertical direction V, the lateral direction L, or the transverse direction T. This enables faucet 116 to be optionally positioned in either of a retracted position and an extended position. FIG. 4 depicts an exemplary embodiment of faucet 116 in a retracted position. Faucet 116 is in the retracted position when it is rotated close enough to lid 104 such that it does not extend within the volume defined by wash basket 110 (FIG. 2) when lid 104 is closed. By placing faucet 116 in this retracted position during normal operation of the washing appliance, faucet 116 does not block or otherwise interrupt the intended agitation of the articles of wash. Likewise, in one embodiment, after pre-treating articles of wash, a user may place faucet 116 in a retracted position when lid 104 is open to prevent any interference from faucet 116 while articles of wash are loaded into wash basket 110 for normal cleaning of the articles by appliance 100.

Figure 6:
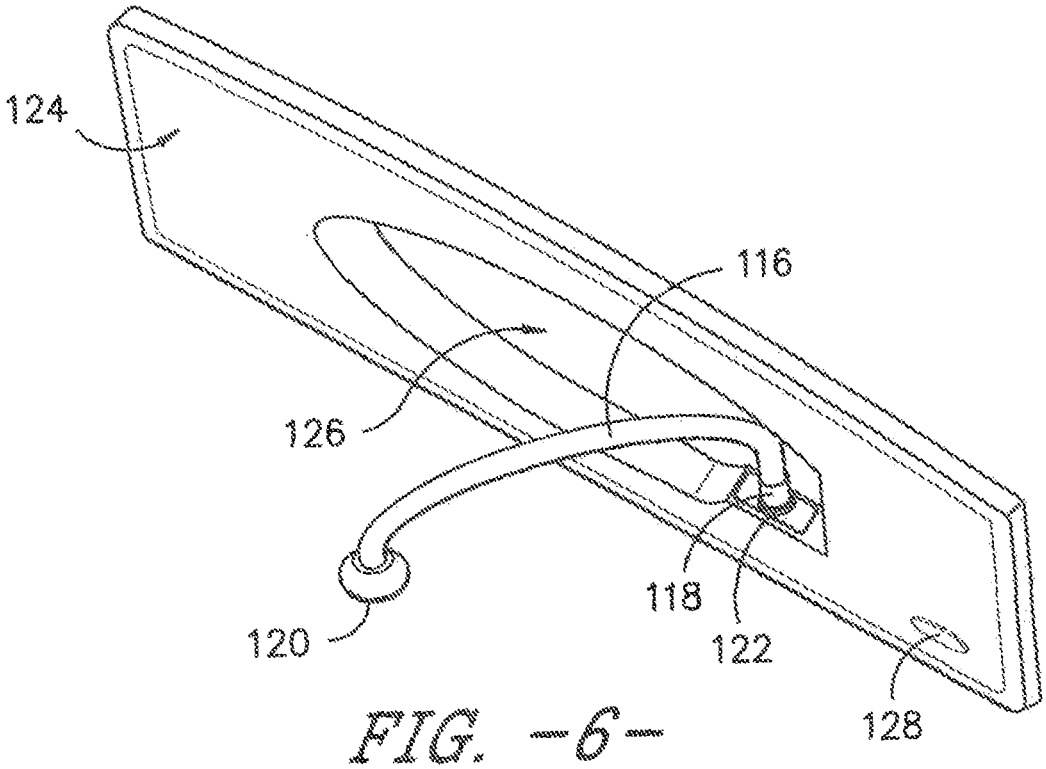
FIG. 6 provides another view of an exemplary embodiment of the lid of a washing machine appliance with an exemplary faucet in the extended position from FIG. 5, but from a different perspective.

Similarly, pivotable joint 122 enables rotation of faucet 116 to an extended position. FIG. 6 depicts an exemplary embodiment of faucet 116 in an extended position. Faucet 116 is in the extended position when lid 104 is open and faucet outlet 120 is over wash basket 110. By rotating faucet 116 into the extended position, water may be deployed over articles of wash for pre-treatment and excess water will fall through wash basket 110 and into the tub, where it can be drained via existing plumbing.

As explained above, lid 104 includes interior lid surface 124 that is concealed from view when lid 104 is in the closed position and exposed to the operator when lid 104 is in the open position. In one embodiment, lid surface 124 includes a recess or depression 126 to provide additional space to prevent the faucet from interfering with the wash basket when the lid is closed and a normal wash cycle is in progress. Depression 126 is sized such that, when faucet 116 is in the retracted position, depression 126 accommodates at least the dimensions of faucet 116 that lie in the same plane as depression 126 for this exemplary embodiment. Depending on the type of faucet and faucet outlet employed, in certain embodiments, the depth of depression 126 may also be sized to accommodate the width of faucet 116. However, depression 126 is not a required element, nor is it necessary that depression 126 contain the full volume of faucet 116, so long as the faucet 116 is outside of wash basket 110 when faucet 116 is in the retracted position and lid 104 is in the closed position. Additionally, as an alternative to mounting faucet 116 to lid surface 124, in certain embodiments, it may instead be mounted anywhere within depression 126 that will accommodate the size of the faucet.

Turning next to the control and operation of faucet 116, washing machine appliance 100 may further include a faucet operation input 128. Actuation of faucet operation input 128 may serve as the user's indication that dispensation of wash fluid from faucet 116 is desired. Faucet operation input 128 may be any button or switch suitable for providing an indication to the controller. For example, faucet operation input 128 may be a push button switch, toggle switch, rocker switch, or any other suitable tactile switch, such as a capacitive touch button. In optional embodiments, faucet operation input 128 is a rotary switch. In other embodiments, faucet operation input 128 may be a biased switch that returns to its unlatched or unpressed state when released (e.g., by spring force). Typically, use of faucet 116 is expected to occur when lid 104 is open and faucet 116 is extended. Accordingly, in some embodiments, such as the depiction of FIG. 2, the opened lid 104 will prevent access to control panel 108. Therefore, faucet operation input 128 must be mounted in another location accessible to the user when lid 104 is open. For example, faucet operation input 128 may be mounted anywhere on surface 124 of lid 104 that is accessible to the user. Alternatively, faucet operation input 128 may be mounted on top panel 106 of washing machine appliance 100. Likewise, faucet operation input 128 may be mounted on the front or either side of cabinet 102. Ultimately, the location of faucet operation input 128 is limited only by the convenient access of the user when lid 104 is open.

As those skilled in the art will recognize, in some embodiments it may be desirable to optionally include additional control features to ensure that faucet 116 does not operate unless lid 104 is open. For example, depending upon the configuration of the water supply system, operation of the faucet while lid 104 is closed could divert wash fluid, during normal operation, intended to be directed into the tub. Likewise, unintended operation of faucet 116 while lid 104 is closed could result in reduced pressure of wash fluid used to fill the tub during normal operation or could interfere with proper mixing or proportions of water and additives combined during normal operation of the washing appliance.

In particular, where faucet operation input 128 is mounted in a location accessible to the user when lid 104 is closed, it may be desirable to add control features that prevent the flow of wash fluid in the event that faucet operation input 128 is actuated unintentionally. Accordingly, in one embodiment, control panel 108 further includes a faucet activation input 113 (shown in FIG. 1). Actuation of faucet activation input 113 provides an indication that the user intends to use faucet 116 and "arms" the system for such use. Thus, faucet activation input 113 provides a check on the use of faucet 116, preventing the flow of wash fluid based on actuation of faucet operation input 128 alone.

Faucet activation input 113 may be any button or switch suitable for providing an indication to the controller (discussed below) that the input has been actuated. For example, faucet activation input 113 may be stable or momentary push button switches, toggle switches, rocker switches, or any other suitable tactile switch, such as capacitive touch buttons. In optional embodiments, faucet activation input 113 is a rotary switch or dial as shown. In other embodiments, faucet activation input 113 may be a biased switch that returns to its unlatched or unpressed state when released (e.g., by spring force). In other embodiments, control panel 108 may further include a display, such as an electronic indicator display, which indicates selected features, operation mode, a countdown timer, or other items of interest to appliance users regarding operation including, but not limited to whether faucet 116 is activated.

As an alternative to faucet activation input 113 (or as an additional control feature), washing machine appliance 100 may also include a position sensor 129 capable of monitoring the position of lid 104 and send a signal to the controller indicating as such. As with faucet activation switch 113, position sensor 129 provides an indication that faucet 116 is ready for use, preventing the unintentional flow of wash fluid based on actuation of faucet operation input 128 alone. Position sensor 129 may be any suitable type of sensor for detecting when lid 104 is in the open position. As an example, position sensor 129 may be a plunger switch that is actuated when lid 104 shifts from the closed position to the open position. As another example, position sensor 129 may be a reed switch or Hall Effect sensor that is actuated, e.g., by a magnet on lid 104, when lid 104 shifts from the closed position to the open position. As an additional example, position sensor 129 may be a pressure sensor or an optical sensor that is actuated when lid 104 shifts from the closed position to the open position. One of ordinary skill in the art will recognize that other types of sensors may be used as position sensor 129 to detect when lid 104 is in the open position.

Figure 3:
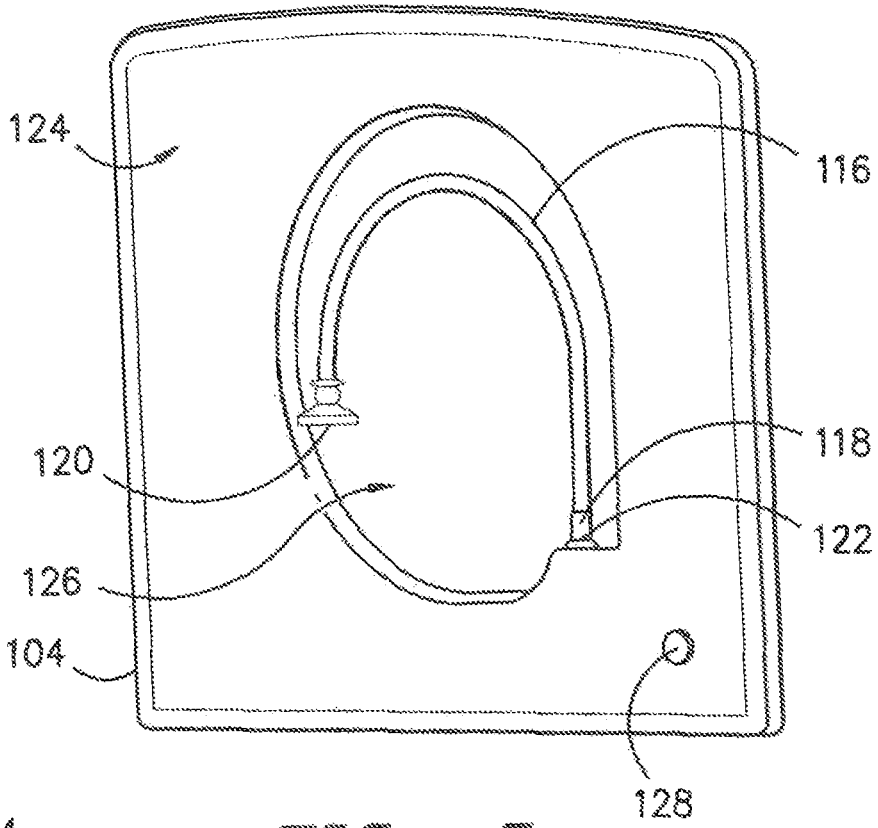
FIG. 3 provides a perspective view of an exemplary embodiment of the lid of a washing machine appliance with an exemplary faucet in the retracted position.
Figure 8:
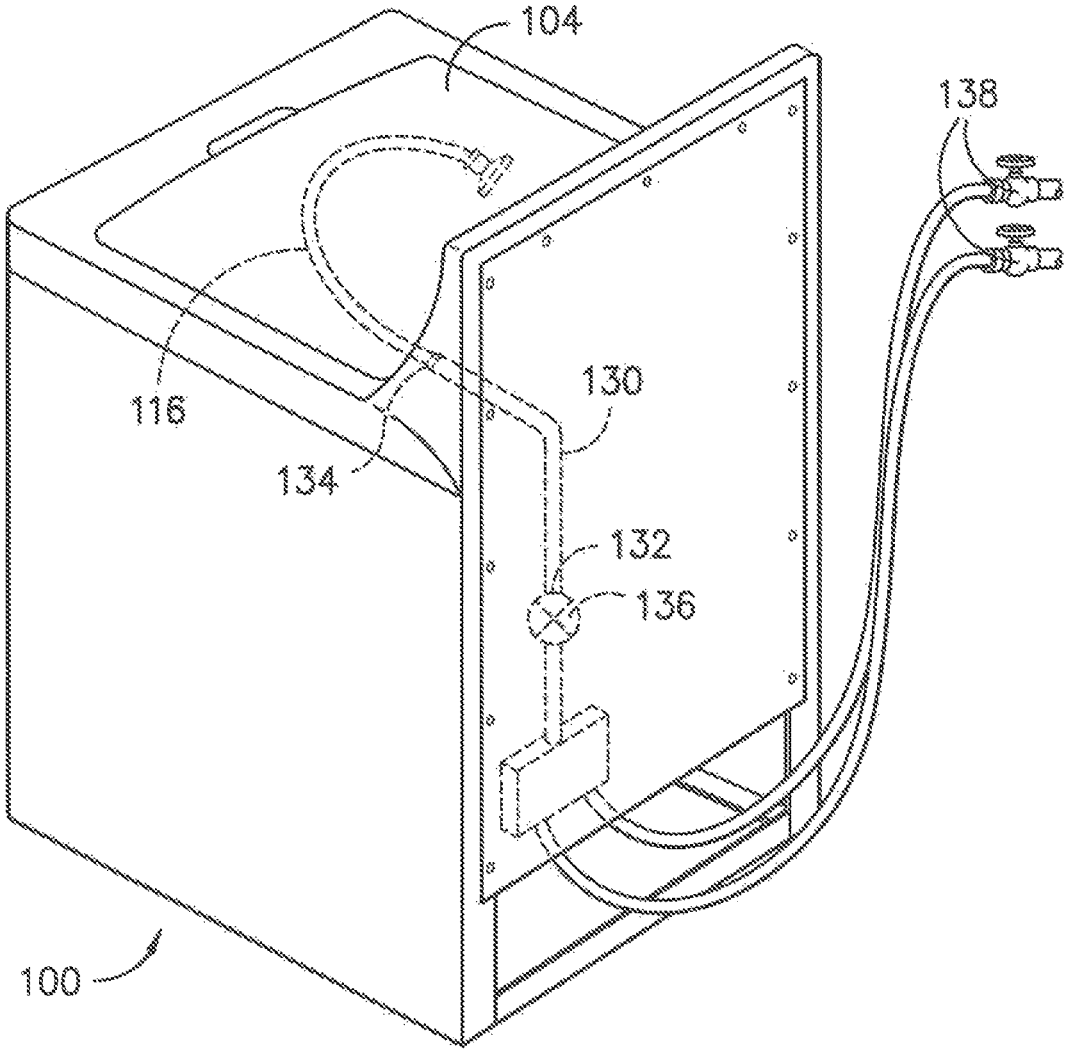
FIG. 8 provides a perspective rear view of an exemplary embodiment of a fluid supply system of a washing machine appliance.

Referring now to FIG. 8, wash fluid may be supplied to faucet 116 from a wash fluid source 138. Wash fluid source 138 may constitute any supply of water under pressure. As shown in this embodiment, it may include separate hot and cold sources that are subsequently mixed prior to dispensation to achieve a desired wash fluid temperature. Alternatively, other embodiments of wash fluid source 138 may constitute a single source of wash fluid of either ambient temperature or preheated wash fluid, for example, from a hot water heater. From wash fluid source 138, wash fluid is delivered at least through one or more fluid supply conduits and one or more valves to faucet inlet 118 (FIG. 3).

As depicted in FIG. 8, in one embodiment, the wash fluid supply system may be regulated by a single valve 136 preferably contained within cabinet 102 of washing appliance 100. Valve 136 may be any suitable mechanically or electromechanically actuated valve, such as a gate valve, mixing valve, solenoid, etc., for selectively controlling the flow of wash fluid. Additionally or alternatively, valve 136 may be provided as a direct current (DC) valve, which is selectively actuated or position based on one or more DC signals directed thereto.

In the embodiment of FIG. 8, the fluid supply system further includes fluid supply conduit 130 at least partially contained within cabinet 102. Fluid supply conduit 130 consists of fluid supply conduit inlet 132 and fluid supply conduit outlet 134. Fluid supply conduit inlet 132 is connected to the outlet of valve 136 such that, when the valve is opened, wash fluid flows out of the valve and through fluid supply conduit 130 to faucet 116. Fluid supply conduit outlet 134 is likewise connected to faucet inlet 118 such that wash fluid passing through fluid supply conduit 130 upon the opening of valve 136 is delivered to faucet 116 for dispensation.

In this exemplary configuration of the wash fluid supply system, operation of valve 136 is the sole element regulating the flow of wash fluid through faucet 116 and therefore requires input from all of the faucet control features prior to dispensing wash fluid. Thus, for an embodiment of washing machine appliance 100 including faucet operation input 128, faucet activation input 113, and position sensor 129, each of these faucet control features must send a control signal prior to opening of valve 136. The actuation of valve 136 is controlled by the controller, which is in communication with valve 136. The controller, in this embodiment, is likewise in communication with faucet activation input 112, faucet operation input 128, and position sensor 129. That is, the controller will send a signal causing actuation of valve 136 only when it has received a control signal indicating actuation from each of faucet activation input 112, faucet operation input 128, and position sensor 129. In this manner, wash fluid is dispensed from faucet 116 only after it is confirmed that the lid is open and that a user has elected to activate the faucet and has indicated that dispensation is immediately desired.

Figure 9:
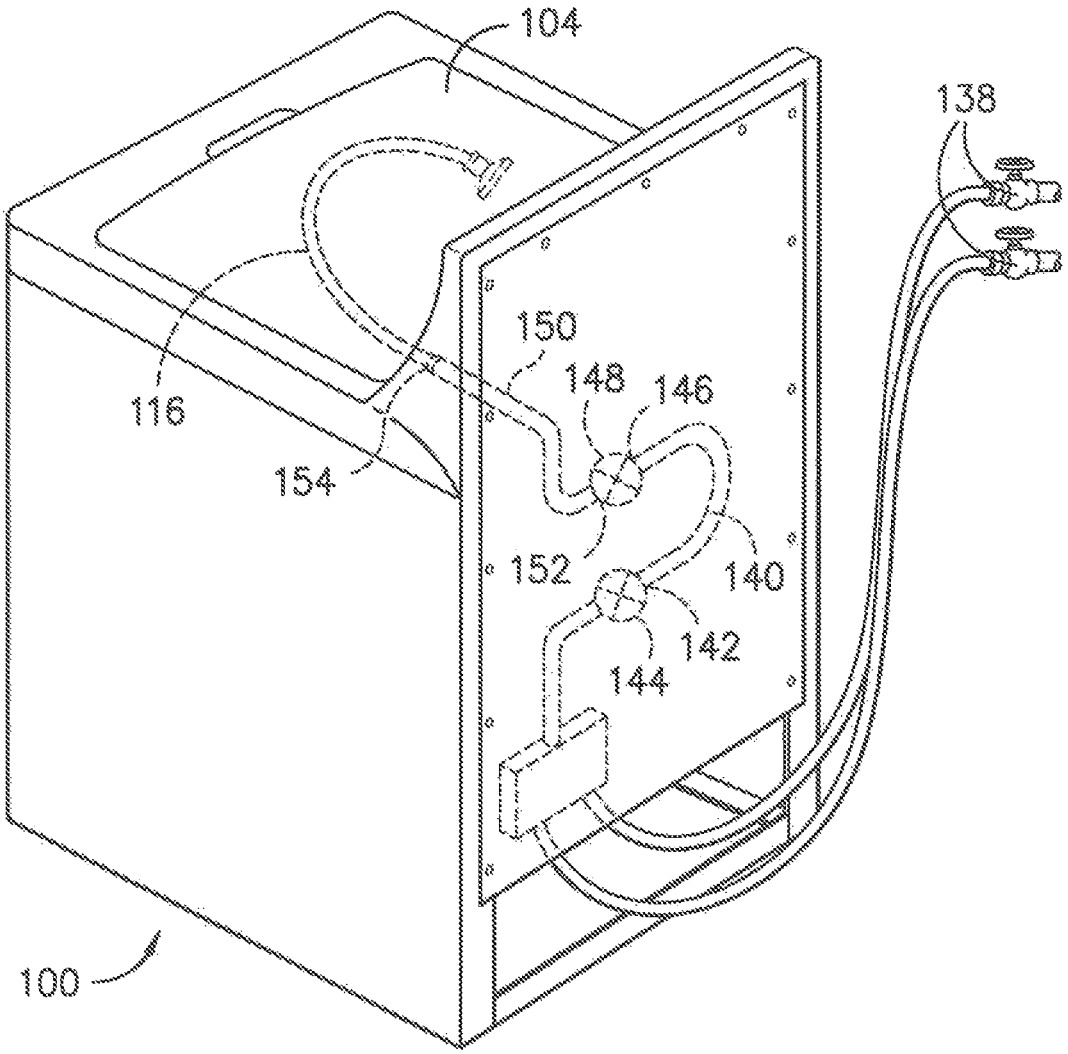
FIG. 9 provides a perspective rear view of an exemplary embodiment of an alternative fluid supply system of a washing machine appliance.

As those skilled in the art will recognize, a wide variety of configurations of the wash fluid supply system are possible consistent with the invention. The wash fluid supply system depicted in FIG. 9 provides an example of a dual valve supply system. In the embodiment of FIG. 9, the wash fluid supply system may be regulated a first valve 144 and a second valve 148, both of which are preferably contained within cabinet 102 of washing appliance 100. First valve 144 and second valve 148 may be any suitable mechanically or electromechanically actuated valve, such as a gate valve, mixing valve, solenoid, etc., for selectively controlling the flow of wash fluid. Additionally or alternatively, either or both of first valve 144 and second valve 148 may be provided as direct current (DC) valves, which are selectively actuated or position based on one or more DC signals directed thereto.

In the embodiment of FIG. 9, the fluid supply system further includes a first supply conduit 140 and a second supply conduit 150, both of which are at least partially contained within cabinet 102. First fluid supply conduit 140 consists of a first fluid supply conduit inlet 142 and a first fluid supply conduit outlet 146. Second fluid supply conduit 150 likewise consists of a second fluid supply conduit inlet 152 and a second fluid supply conduit outlet 154. First fluid supply conduit inlet 142 is connected to the outlet of first valve 144 such that, when the valve is opened, wash fluid flows out of the valve and through first fluid supply conduit 140. First fluid supply conduit outlet 146 is similarly connected to the inlet of second valve 148. Continuing on, second fluid supply conduit inlet 152 is connected to the outlet of second valve 148 such that wash fluid passing through second fluid supply conduit 150 upon the opening of second valve 148. And finally, second fluid supply conduit outlet 154 is connected to faucet inlet 118 such that wash fluid passing through second fluid supply conduit 150 is delivered to faucet 116 for dispensation.

In this exemplary configuration of the wash fluid supply system, actuation of both first valve 144 and second valve 148 are both required to permit the flow of wash fluid through the faucet. As will be obvious to those skilled in the art, each of the faucet control features that are part of washing machine appliance 100, as described above, must trigger at least the opening of either first valve 144 or second valve 148. The skilled artisan will recognize that there are a variety of combinations for controlling actuation of first valve 144 and second valve 148 based on the control features described above, and depending on the control features employed in a particular embodiment.

For example, the actuation of first valve 144 and second valve 148 is controlled by the controller, which is in communication with both first valve 144 and second valve 148. The controller is likewise in communication with faucet activation input 112, faucet operation input 128, and, if utilized, position sensor 129. When position sensor 129 is employed the controller may send a signal causing actuation of first valve 144 only when it has received signals indicating actuation from each of faucet activation input 112 and position sensor 129. In this situation, the controller may then send a signal causing actuation of second valve 148 only when it has received a signal indicating actuation of faucet operation input 128. Alternatively, the controller may send a signal causing actuation of first valve 144 only when it has received a signal indicating actuation from faucet activation input 112 and send a signal causing actuation of second valve 148 only when it has received signals indicating actuation from each of faucet operation input 128 and position sensor 129.

Continuing consideration of the fluid supply system depicted in FIG. 9, but in an embodiment lacking position sensor 129, the controller may send a signal causing actuation of first valve 144 only when it has received as signal indicating actuation of faucet activation input 112 and it may send a signal causing actuation of second valve 148 only when it has received a signal indicating actuation of faucet operation input 128. Of course, these scenarios are merely exemplary, and different combinations of valves and signals from the control features may be employed, as would be obvious to one of ordinary skill in the art, so long as the combination utilized permits the flow of wash fluid to be dispensed from faucet 116 after a user has elected to activate the faucet and has indicated that dispensation is immediately desired (and, if a position sensor is employed, that the lid is open).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a cabinet;
- a tub positioned within the cabinet;
- a wash basket rotatably mounted within the tub, the wash basket defining a wash chamber for receiving articles for washing;
- a lid mounted to a top panel of the cabinet, the lid being adjustable between a closed position and an open position, the lid positioned over the wash tub in the closed position; and
- a faucet having an inlet and an outlet, wherein the lid comprises a surface which faces the wash basket when the lid is closed, the surface having a depression,
  - the faucet mounted within the depression on the surface of the lid with a pivotable joint such that the faucet may pivot relative to the lid about at least one of the vertical direction, the lateral direction, or the transverse direction between:
    - a retracted position, wherein the faucet does not extend within the wash basket when the lid is in the closed position, and
    - an extended position, wherein the outlet of the faucet is over the wash basket when the lid is in the open position,
    - the inlet of the faucet connected to a wash fluid source and configured for selectively providing a flow of wash fluid into the wash basket when the lid is open; and
- wherein the pivotable joint is configured to enable rotation of the faucet relative to the lid in one or more of the lateral direction and the transverse direction.

2. The washing machine appliance of claim 1, wherein the depression is sized to accommodate the faucet when the faucet is in the retracted position such that at least a portion of the volume of the faucet does not extend into the tub.

3. The washing machine appliance of claim 1, further comprising a fluid supply conduit at least partially contained within the cabinet having an inlet connected to a valve controlling the flow of wash fluid from a wash fluid source and an outlet connected to the inlet of the faucet.

4. The washing machine appliance of claim 3, further comprising a faucet operation input mounted in a position on the washing machine appliance accessible when the lid is open.

5. The washing machine appliance of claim 4, further comprising:
- a control panel positioned on the cabinet, the control panel comprising
  - a plurality of user inputs, including a faucet activation input, and
  - a controller in operative communication with the valve, the faucet activation input, and the faucet operation input, the controller configured to actuate the valve in response to actuation of both the faucet activation input and the faucet operation input.

6. The washing machine appliance of claim 1, further comprising
- a first fluid supply conduit at least partially contained within the cabinet having an inlet connected to a first valve controlling the flow of wash fluid from a wash fluid source and an outlet connected to a second valve controlling the flow of wash fluid, and
- a second fluid supply conduit at least partially contained within the cabinet having an inlet connected to the second valve and an outlet connected to inlet of the faucet.

7. The washing machine appliance of claim 6, further comprising a faucet operation input mounted in a position on the washing machine appliance accessible when the lid is open.

8. The washing machine appliance of claim 7, further comprising:
- a control panel positioned on the cabinet, the control panel comprising
  - a plurality of user inputs, including a faucet activation input, and
  - a controller in operative communication with the first valve, the second valve, the faucet activation input, and the faucet operation input, the controller configured to actuate the first valve in response to actuation of the faucet activation input and to actuate the second valve in response to actuation of the faucet operation input.

9. A washing machine appliance comprising:
- a cabinet;
- a tub positioned within the cabinet;
- a wash basket rotatably mounted within the tub, the wash basket defining a wash chamber for receiving articles for washing;
- a lid mounted to a top panel of the cabinet, the lid being adjustable between a closed position and an open position, the lid positioned over the wash tub in the closed position;
- a position sensor operable to sense whether the lid is in the closed position or the open position; and
- a faucet having an inlet and an outlet, wherein the lid comprises a surface which faces the wash basket when the lid is closed, the surface having a depression,
  - the faucet mounted within the depression on the surface of the lid with a pivotable joint such that the faucet may pivot relative to the lid about at least one of the vertical direction, the lateral direction, or the transverse direction between:

a retracted position, wherein the faucet does not extend within the wash basket when the lid is in the closed position, and an extended position, wherein the outlet of the faucet is over the wash basket when the lid is in the open position, the inlet of the faucet connected to a wash fluid source and configured for selectively providing a flow of wash fluid into the wash basket when the lid is open; and wherein the pivotable joint is configured to enable rotation of the faucet relative to the lid in one or more of the lateral direction and the transverse direction.

10. The washing machine appliance of claim 9, wherein the depression is sized to accommodate the faucet when the faucet is in the retracted position such that at least a portion of the volume of the faucet does not extend into the tub.

11. The washing machine appliance of claim 9, further comprising a fluid supply conduit at least partially contained within the cabinet having an inlet connected to a valve controlling the flow of wash fluid from a wash fluid source and an outlet connected to the inlet of the faucet.

12. The washing machine appliance of claim 11, further comprising a faucet operation input mounted in a position on the washing machine appliance accessible when the lid is open.

13. The washing machine appliance of claim 12, further comprising:

a control panel positioned on the cabinet, the control panel comprising a plurality of user inputs, including a faucet activation input, and a controller in operative communication with the valve, the faucet activation input, the faucet operation input, and the position sensor, the controller configured to actuate the valve in response to actuation of both the faucet activation input, the faucet operation input, and a signal from the position sensor.

14. The washing machine appliance of claim 9, further comprising a first fluid supply conduit at least partially contained within the cabinet having an inlet connected to a first valve controlling the flow of wash fluid from a wash fluid source and an outlet connected to a second valve controlling the flow of wash fluid, and a second fluid supply conduit at least partially contained within the cabinet having an inlet connected to the second valve and an outlet connected to inlet of the faucet.

15. The washing machine appliance of claim 14, further comprising a faucet operation input mounted in a position on the washing machine appliance accessible when the lid is open.

16. The washing machine appliance of claim 15, further comprising:

a control panel positioned on the cabinet, the control panel comprising a plurality of user inputs, including a faucet activation input, and a controller in operative communication with the first valve, the second valve, the position sensor, the faucet activation input, and the faucet operation input, the controller configured to actuate the first valve in response to actuation of the faucet activation input and a signal from the position sensor and to actuate the second valve in response to actuation of the faucet operation input.

17. The washing machine appliance of claim 15, further comprising:

a control panel positioned on the cabinet, the control panel comprising a plurality of user inputs, including a faucet activation input, and a controller in operative communication with the first valve, the second valve, the position sensor, the faucet activation input, and the faucet operation input, the controller configured to actuate the first valve in response to actuation of the faucet activation input and to actuate the second valve in response to actuation of the faucet operation input and a signal from the position sensor.

* * * * *